US011359852B2

(12) United States Patent
Ros

(10) Patent No.: US 11,359,852 B2
(45) Date of Patent: Jun. 14, 2022

(54) TRANSPORT CONTAINER FOR TRANSPORTING TEMPERATURE-SENSITIVE TRANSPORT GOODS

(71) Applicant: REP IP AG, Zug (CH)

(72) Inventor: Nico Ros, Riehen (CH)

(73) Assignee: REP IP AG, Zug (CH)

( * ) Notice: Subject to any disclaimer, the term of this patent is extended or adjusted under 35 U.S.C. 154(b) by 0 days.

(21) Appl. No.: 15/224,125

(22) Filed: Jul. 29, 2016

(65) Prior Publication Data

US 2017/0038114 A1 Feb. 9, 2017

(30) Foreign Application Priority Data

Aug. 4, 2015 (AT) ..... A 517/2015

(51) Int. Cl.

| | |
|---|---|
| ***F25D 3/06*** | (2006.01) |
| ***F25B 21/02*** | (2006.01) |
| ***A61J 1/16*** | (2006.01) |

(52) U.S. Cl.

CPC ..... *F25D 3/06* (2013.01); *A61J 1/165* (2013.01); *F25B 21/02* (2013.01); *A61J 2200/50* (2013.01); *F25D 2201/10* (2013.01); *F25D 2303/0831* (2013.01); *F25D 2303/0843* (2013.01); *F25D 2303/0844* (2013.01); *F25D 2303/0845* (2013.01)

(58) Field of Classification Search

CPC .... F25B 21/02; F25B 21/04; F25B 2321/023; F25D 3/06; F25D 2201/10; F25D 2303/0843; F25D 2303/0844; F25D 2303/0845; F25D 2303/0831; F25D 3/08; F25D 11/006; F25D 11/003; F25D 23/06; A61J 1/165

USPC ..... 62/434, 530

See application file for complete search history.

(56) References Cited

U.S. PATENT DOCUMENTS

| | | | | |
|---|---|---|---|---|
| 5,417,082 | A | 5/1995 | Foster et al. | |
| 6,105,659 | A | 8/2000 | Pocol et al. | |
| 6,666,032 | B1 * | 12/2003 | Rickson | A61J 1/165 62/3.6 |

(Continued)

FOREIGN PATENT DOCUMENTS

| | | | |
|---|---|---|---|
| DE | 10303498 | A1 | 8/2004 |
| DE | 102013002555 | A1 | 6/2014 |

(Continued)

OTHER PUBLICATIONS

Search Report dated Feb. 19, 2016, in corresponding Austrian Application No. 517/2015 (1 Page).

(Continued)

*Primary Examiner* — David J Teitelbaum

(57) ABSTRACT

A transport container for transporting temperature-sensitive transport goods, including an interior for receiving the transport goods, is definable by an enclosure made up of several layers including at least one latent heat accumulator layer or at least one latent heat accumulator element, at least one energy distribution layer made of a highly heat-conductive material disposed on a side facing away from the interior, and/or on the side facing the interior, of the at least one latent heat accumulator layer and/or the at least one latent heat accumulator element.

16 Claims, 2 Drawing Sheets

(56) References Cited

U.S. PATENT DOCUMENTS

| | | | | |
|---|---|---|---|---|
| 8,726,688 | B2 * | 5/2014 | Ghiraldi | F25D 11/006 62/438 |
| 2005/0016198 | A1 * | 1/2005 | Wowk | A01N 1/0257 62/371 |
| 2006/0248902 | A1 | 11/2006 | Hunnell | |
| 2008/0099492 | A1 | 5/2008 | Mayer | |
| 2009/0078708 | A1 | 3/2009 | Williams | |
| 2009/0123815 | A1 * | 5/2009 | Alkemade | H01M 10/625 429/50 |
| 2010/0024439 | A1 | 2/2010 | Finke et al. | |
| 2010/0170286 | A1 * | 7/2010 | Ghiraldi | F25D 11/006 62/434 |
| 2011/0061409 | A2 * | 3/2011 | Dering | B01D 53/265 62/115 |
| 2011/0099814 | A1 * | 5/2011 | Fuerst | A45D 27/46 30/34.05 |
| 2011/0247356 | A1 | 10/2011 | Krosse et al. | |
| 2012/0148886 | A1 * | 6/2012 | Krause | H01M 10/625 429/72 |
| 2012/0153874 | A1 * | 6/2012 | Lachenmeier | B60K 6/105 318/1 |
| 2012/0183724 | A1 | 7/2012 | Ros et al. | |
| 2014/0311170 | A1 * | 10/2014 | Mills | F25D 11/003 62/62 |
| 2015/0292787 | A1 | 10/2015 | Kuhn et al. | |
| 2015/0330697 | A1 * | 11/2015 | Tanaka | B65D 81/3825 62/457.2 |
| 2018/0266746 | A1 * | 9/2018 | Urayama | B65D 81/3823 |

FOREIGN PATENT DOCUMENTS

| | | | |
|---|---|---|---|
| GB | 1040218 | A | 8/1966 |
| GB | 1569134 | A | 6/1980 |
| JP | H11270978 | A | 10/1999 |
| JP | 2004156839 | A | 6/2004 |
| JP | 2004317041 | A | 11/2004 |
| WO | 2000021830 | A1 | 4/2000 |
| WO | 2011/032299 | A1 | 3/2011 |

OTHER PUBLICATIONS

Office Action issued against EP Patent Application No. 16450011.8 dated Sep. 21, 2020 in German (7 pages).

* cited by examiner

TRANSPORT CONTAINER FOR TRANSPORTING TEMPERATURE-SENSITIVE TRANSPORT GOODS

CROSS-REFERENCE TO RELATED APPLICATIONS

This application claims priority from Austrian Patent Application No. A 517/2015, filed Aug. 4, 2015 which is hereby incorporated herein by reference in its entirety for all purposes.

FIELD

A transport container for transporting temperature-sensitive transport goods, including an interior for receiving the transport goods, can be characterized has having an enclosure comprised of several layers, including at least one latent heat accumulator layer and/or at least one latent heat accumulator element.

BACKGROUND

When transporting temperature-sensitive transport goods, such as e.g. pharmaceuticals, over periods of several hours or days, predefined temperature ranges will have to be maintained during storage and transport in order to safeguard the usability and safety of the pharmaceuticals. Temperature ranges from 2 to 25° C., in particular 2 to 8°, are defined for different pharmaceuticals.

The desired temperature range can be above or below ambient temperature, thus requiring either cooling or heating of the interior of the transport container. If the ambient conditions change during a transport procedure, the required temperature control may comprise both cooling and heating. In order that the desired temperature range will be permanently and verifiably maintained, transport containers with special insulation capacities are used. Such containers are equipped with passive or active temperature-control elements. Passive temperature-control elements do not require external energy supply during application, but rather use their heat storing capacity, involving, as a function of the temperature level, the release or absorption of heat to and respectively from the interior of the transport container to be temperature-controlled. Such passive temperature-control elements are, however, depleted once the temperature equalization with the interior of the transport container has been completed.

A special type of passive temperature-control elements are latent heat accumulators, which are able to store thermal energy in phase-change materials, whose latent heat of fusion, heat of solution or heat of absorption is substantially higher than the heat they are able to store on account of their normal specific heat capacity. Latent heat accumulators involve the drawback of losing their effect once all of the material has experienced a complete phase change. However, the latent heat accumulator can be recharged by carrying out an inverse phase change.

Active temperature-control elements require an external energy supply for their operation. They are based on the conversion of a non-thermal type of energy into a thermal type of energy. The release or absorption of heat in this case, for instance, takes place in the context of a thermodynamic cycle process, e.g. by using a compression refrigerating machine. Another active temperature-control element configuration operates based on the thermoelectric principle by using so-called Peltier elements.

Transport containers of the initially defined kind involve the problem of the input of energy into the transport container being heterogeneous during transport. If the container is exposed to heat radiation, the energy input in the region of exposure is clearly higher than in regions where the container is not exposed to radiation. Nevertheless, the temperature in the interior of the container must be kept constant and homogeneous within an admissible range. An inhomogeneous energy input would involve the problem of the latent heat accumulator being not homogeneously depleted. Thus, local temperature changes would occur in the interior of the transport container after some time. If the local temperature changes exceed, or fall below, a defined threshold value, the transport goods will no longer be protected.

As a result, transport containers are usually designed such that each side functions independently. Consequently, each side has to be designed for the maximum possible load. The energy potential of one region, however, cannot be used for another region. If, for instance, heat radiation acts on the transport container from above, this energy will be absorbed by the latent heat accumulator element in the upper region by experiencing a phase transition. Once such a phase transition has occurred, the energy will reach the interior of the container, causing heating in the upper region of the container. The energy absorption potential of the latent heat accumulator element still existing in the lower region cannot be utilized. This is the reason why in conventional transport containers, in which the temperature is controlled by latent heat accumulator elements, each side is independently designed for the maximum thermal energy input expected. This will, however, lead to a considerably higher weight and/or a clear increase in volume. Both will result in a marked loss of efficiency during transport. In most cases, pharmaceutical products are transported by aircraft, where already a slight increase in weight or volume will entail a significant increase in costs.

SUMMARY

The transport container, therefore, thus aims to overcome the above-identified drawbacks and, in particular, maximize the volume of the transport container usable for the transport goods, without affecting the temperature retention capacity. The transport container enables reduced transport costs per unit weight of the transport goods.

To accomplish these and other objectives, a present transport container of the initially defined kind essentially provides that at least one energy distribution layer made of a highly heat-conductive material is disposed on the side facing away from the interior of the transport container, and/or on the side facing the interior, of the at least one latent heat accumulator layer or the at least one latent heat accumulator element.

With a structure in which at least one energy distribution layer is disposed on the side facing away from the interior, and of the at least one latent heat accumulator layer and/or of the at least one latent heat accumulator element, it is now possible to distribute the thermal energy acting from outside, in particular as heat radiation, for instance on just one side of the transport container, to the other side of the container. The at least one energy distribution layer disposed radially outside the latent heat accumulator layer or the at least one latent heat accumulator element surrounds the interior of the transport container, preferably on all sides so as to cause the thermal energy acting thereon to be distributed over the entire periphery of the enclosure.

The thus distributed energy is transmitted to the further inwardly disposed layers of the container wall, thus leading to a latent heat accumulator consumption that is uniform over the extension of the latent heat accumulator layer or the at least one latent heat accumulator element.

By preference, the volume of the latent heat accumulator to be provided should be designed not just for the maximum energy input to be expected on each side, but also has to be configured to account for the sum of the energy input to be expected on all sides. Since it is to be anticipated that not all sides of the transport container will each be exposed to the maximum energy input to be expected, the overall volume of the latent heat accumulator can be reduced.

The arrangement of the at least one energy distribution layer on the side facing the interior of the at least one latent heat accumulator layer or the at least one latent heat accumulator element will cause the thermal energy in the interior of the transport container to be homogenized. Hot air forming in the interior (e.g., by introducing hot transport goods that heat the air) will always collect in the upper region of the interior, where an excessive latent heat accumulator consumption will occur. Having an energy distribution layer disposed radially within the latent heat accumulator layer and/or the at least one latent heat accumulator element, enables the thermal energy to be absorbed from the interior to be uniformly distributed over the whole latent heat accumulator, without any auxiliary means. Consequently, it is possible that no forced convection may be required in the interior, which translates into reduced equipment and operating costs since the respective blowers and the like can be obviated in addition to providing a transport container having reduced weight.

Another advantage of one of the configurations of a transport container resides in that the latent heat accumulator does not need to necessarily surround the interior completely, i.e. does not need to be designed as a latent heat accumulator layer enclosing the interior on all sides. It rather suffices to provide one or several latent heat accumulator element(s) locally, i.e. on one, two or three sides of the interior. Hence additional volume savings are achieved.

The at least one energy distribution layer can be arranged either radially outside or radially inside the at least one latent heat accumulator layer or the at least one latent heat accumulator element, depending on whether the energy distribution acting from outside or the energy distribution within the interior has priority. This will, inter alia, also depend on the dimensions of the transport container. In a preferred manner, at least one energy distribution layer is each provided radially outside and radially within the at least one latent heat accumulator layer and/or the at least one latent heat accumulator element. By preference, the two energy distribution layers each surround the interior of the transport container on all sides.

The peripheral energy distribution, according to various preferred aspects of a transport container, involves a further development in that such energy distribution is encouraged in that at least one insulation layer is disposed on the side facing away from the interior, of the at least one latent heat accumulator layer or the at least one latent heat accumulator element, wherein the energy distribution layer disposed on the side facing away from the interior, of the at least one latent heat accumulator layer or the at least one latent heat accumulator element is preferably disposed between the insulation layer and the latent heat accumulator layer or the latent heat accumulator element. The insulation layer allows for a reduction of the energy flow in the radial direction towards the interior of the transport container. The insulation layer surrounds the interior of the transport container, preferably on all sides.

Further equalization of the thermal energy acting on the latent heat accumulator is preferably achieved in that at least two energy distribution layers made of a highly heat-conductive material are disposed on the side facing away from the interior, of the at least one latent heat accumulator layer or the latent heat accumulator element. The insulation layer is preferably disposed between the two energy distribution layers.

One of the energy distribution layers may constitute the outer surface of the transport container, i.e., an energy distribution layer forms the outer layer of the transport container wall. This also encompasses configurations in which the energy distribution layer carries a protective layer or decorative layer on its outer side. Such a protective layer or decorative layer has substantially no effect as regards the thermal properties of the transport container, but serves as a protection of the energy distribution layer against external influences, such as e.g. abrasive influences, or serves to make imprints or the like.

The at least one energy distribution layer is preferably designed and dimensioned such that the maximum temperature difference in the interior of the transport container is 5 Kelvin, preferably 8 Kelvin, at most.

The at least one energy distribution layer preferably comprises a thermal conductivity $\lambda > 200$ W/(m·K).

Such thermal conductivity values can be achieved in that the respective energy distribution layer is made at least partially, preferably completely, of suitable material having the requisite thermal conductivity, such as aluminum, copper or carbon nanotubes. Aluminum has a thermal conductivity of about 236 W/(m·K). Copper has a thermal conductivity of about 401 W/(m·K). Carbon nanotubes have a thermal conductivity of 6000 W/(m·K). The respective energy distribution layer can also be comprised of at least two different materials having different thermal conductivities.

The insulation layer preferably comprises a conductivity $\lambda < 0.05$ W/(m·K), preferably $< 0.03$ W/(m·K). Moreover, the insulation layer has a thickness of 10 to 200 mm.

The insulation layer is preferably designed as a vacuum insulation. The insulation layer in this case preferably comprises at least one hollow space that is evacuated. Alternatively, the at least one hollow space can be filled with a gas of low thermal conductivity. Furthermore, the insulation layer can comprise a honeycomb-like structure. Thus, an advantageous configuration results with an insulation layer comprising a honeycomb structure, in particular a plurality of honeycombed hollow chambers. A honeycomb structure as described in WO 2011/032299 A1, the disclosure of which is incorporated herein by reference, is particularly advantageous.

With direct sun radiation, up to 1000 W/m$^2$ heat radiation may impinge on the transport container, thus causing a big temperature difference on its surface. With an external energy distribution layer of aluminum having a thickness of 2 mm, 0.002 m*236 W/(m*K)=0.472 W/K is, for instance, conducted tangentially. By increasing the layer thickness, this value can, of course, be raised. By means of an insulation material the energy flow is reduced radially towards the interior of the transport container. With an insulation layer thickness of 0.1 m and an insulation material having a thermal conductivity of 0.02 W/(m*K), the amount of energy conducted to the interior is reduced to 0.02 W/(m*K)/0.1 m=0.2 W/(m$^2$*K).

With a homogeneous insulation material and insulation thickness, the amount of energy arriving at the inside of the insulation layer is directly proportional to the surface temperature of the external energy distribution layer. With a further energy distribution layer, temperature differences occurring in the peripheral direction of the container wall will be further homogenized on the latent heat accumulator. The thickness of such a further energy distribution layer is preferably a function of the maximum temperature difference admissible in the interior. The energy flow in such a further energy distribution layer can be selectively customized by using different conductive materials, different material thicknesses, or openings in the material. Ideally, this layer is designed such that the maximum temperature difference in the interior is less than 5 Kelvin, in particular less than 8 Kelvin.

The required conductivity of the further energy distribution layer is a function of the maximum energy input into this layer. The latter results from the temperature difference within the external distribution layer and from the energy flow through the insulation layer. Based on the above-mentioned example, the maximum energy input at a temperature difference of 50 Kelvin is 0.2 $W/(m^2*K)*50K=10 W/m^2$. The further energy distribution layer thus has to be able to conduct this energy at a maximum temperature difference of 8 Kelvin in the interior.

In order to selectively influence the energy flow through the at least one energy distribution layer, a preferred configuration provides that the at least one energy distribution layer comprises portions of smaller cross section and portions of larger cross section. Alternatively or additionally, the at least one energy distribution layer may comprise openings for the same purpose.

The latent heat accumulator layer is preferably designed as a flat chemical latent heat accumulator, and conventional configurations for the medium forming the latent heat accumulator are usable. Preferred media for the latent heat accumulator comprise paraffins and salt mixtures. In terms of temperature, the phase transition of the medium preferably ranges from 0-10° C. or between 2-25° C.

In order to recharge the latent heat accumulator, if necessary, the latter can be used in combination with at least one active temperature-control element. In such embodiment(s), a transport container can comprise an enclosure further comprising an active temperature-control layer or an active temperature-control element. Alternatively or additionally, the active temperature-control layer or active temperature-control element can also be used to directly control the interior of the container in terms of temperature.

The active temperature-control layer or active temperature-control element is preferably a layer or element for converting electric energy into heat to be released or absorbed. For the purpose of feeding the required electric energy, the transport container, on its outer side, is preferably equipped with connection means, in particular an electric socket, for electrically connecting an external power source. Once an external power source is available, the active temperature-control layer or active temperature-control element can thus be taken into operation.

It may, moreover, be provided that the transport container comprises an electric energy storage means such as an accumulator, which can be fed from an external power source. The electric energy accumulator can be arranged in order to supply the control and, optionally, temperature monitoring electronics of the transport container with electric energy. Furthermore, the electric energy accumulator can be connected to the active temperature-control layer or active temperature-control element to feed electric energy to the latter, if required. This enables an at least short-term operation of the active temperature-control layer or active temperature-control element even during transport, when no external power source is available.

A preferred configuration(s) provides that the active temperature-control layer or active temperature-control element comprises Peltier elements, a heat exchanger cooperating with a thermodynamic cycle process, in particular with a compression refrigerating machine, or magnetic cooling. In a particularly preferred manner, Peltier elements are employed, because these can be small-structured and easily integrated in the temperature-control layer. The temperature-control layer preferably comprises a plurality of Peltier elements, whose cold and hot sides are each connected to a common plate-shaped heat-conducting element. The plate-shaped heat-conducting elements thus constitute the upper and lower sides of the temperature-control layer, carrying Peltier elements disposed therebetween.

The active temperature-control element can be integrated in the latent heat accumulator layer or latent heat accumulator element. In this respect, the temperature-control element can be designed as a cooling coil extending in the latent heat accumulator layer or latent heat accumulator element, as examples.

BRIEF DESCRIPTION OF THE DRAWINGS

Exemplary embodiments of a transport container are schematically illustrated in the Figures.

DETAILED DESCRIPTION

Figure 1:
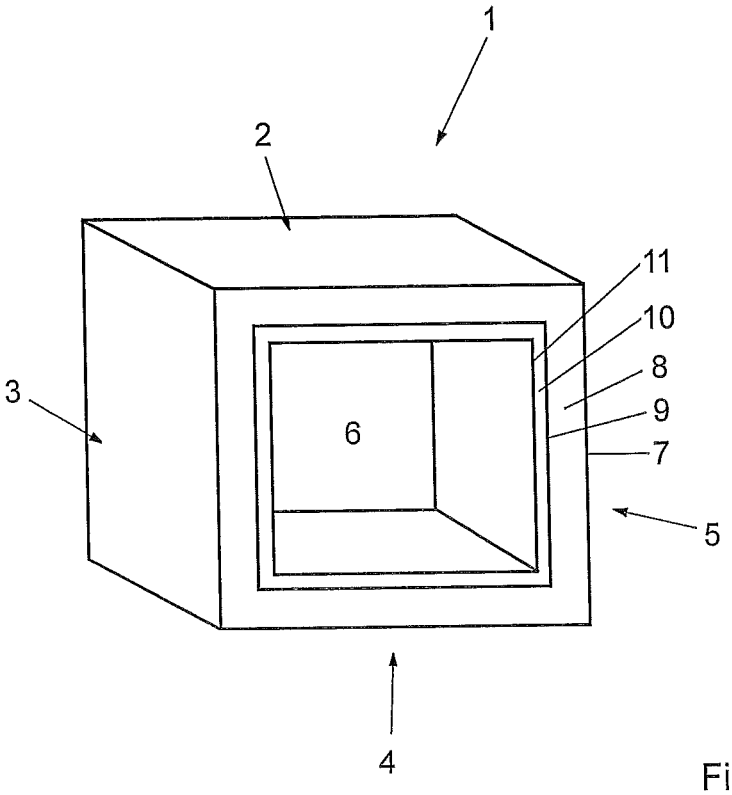
FIG. 1 illustrates a first configuration of the transport container according to the invention.

A transport container for transporting temperature-sensitive transport goods includes an interior for receiving the transport goods, which is characterized by an enclosure made up of several layers comprising at least one latent heat accumulator layer or at least one latent heat accumulator element, wherein at least one energy distribution layer made of a highly heat-conductive material is disposed on the side facing away from the interior, and/or on the side facing the interior, of the at least one latent heat accumulator layer or the at least one latent heat accumulator element.

A transport container according to any embodiment can be further characterized with further a feature(s) as described herein.

A transport container can be further characterized in that at least one insulation layer is disposed on a side facing away from the interior, of the at least one latent heat accumulator layer and/or the at least one latent heat accumulator element, wherein the energy distribution layer disposed on the side facing away from the interior, of the at least one latent heat accumulator layer or the at least one latent heat accumulator element is preferably disposed between the insulation layer and the latent heat accumulator layer (10) or the latent heat accumulator element.

A transport container can be further characterized in that at least two energy distribution layers made of a highly heat-conductive material are disposed on the side facing away from the interior, of the at least one latent heat accumulator layer or the latent heat accumulator element, the insulation layer being preferably disposed between the two energy distribution layers.

A transport container can be further characterized in that the insulation layer exhibits a conductivity $\lambda<0.05$ W/(m·K), preferably <0.03 W/(m·K).

A transport container can be further characterized in that the insulation layer has a thickness of 10 to 200 mm.

A transport container can be further characterized in that the at least one energy distribution layer comprises a thermal conductivity $\lambda>200$ W/(m·K).

A transport container can be further characterized in that the at least one energy distribution layer is made at least partially of aluminum, copper or carbon nanotubes.

A transport container can be further characterized in that the at least one energy distribution layer is comprised of at least two different materials having different thermal conductivities.

A transport container can be further characterized in that at least one of the energy distribution layers comprises portions of smaller cross section and portions of larger cross section.

A transport container can be further characterized in that at least one of the energy distribution layers comprises openings.

A transport container can be further characterized in that the enclosure further comprises an active temperature-control layer.

A transport container can be further characterized in that on the side facing away from the interior and on the side facing the interior of the at least one latent heat accumulator layer at least one energy distribution layer is each arranged, which surrounds the interior of the transport container on all sides, respectively, and that on the side facing away from the interior of the at least one latent heat accumulator layer at least one insulation layer is arranged, wherein the energy distribution layer disposed on the side facing away from the interior of the at least one latent heat accumulator layer is preferably disposed between the insulation layer and the latent heat accumulator layer.

An illustrative transport container is explained in more detail by way of exemplary embodiments schematically illustrated in the Figures. It will be appreciated that other embodiments are described herein.

An exemplary embodiment is depicted in FIG. 1. FIG. 1 depicts a parallelepiped-shaped transport container 1 whose walls are denoted by 2, 3, 4, 5 and 6. On the sixth side, the transport container 1 is shown open to visualize the layered structure of the walls. The open side can, for instance, be closed by a door, which preferably has the same layered structure as the walls 2, 3, 4, 5 and 6. By preference, all of the six walls of the transport container 1 have identical layered structures. The layered structure comprises an external energy distribution layer 7, e.g. of aluminum, an insulation layer 8, a further energy distribution layer 9, a latent heat accumulator layer 10 and an internal energy distribution layer 11.

Figure 2:
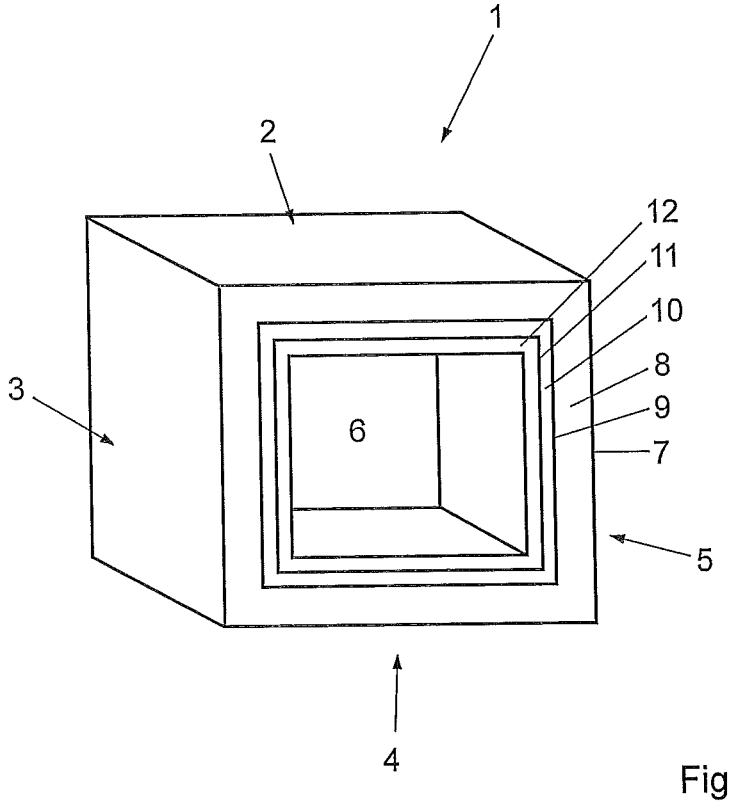
FIG. 2 depicts a second configuration of the transport container according to the invention.

The configuration according to FIG. 2 corresponds to the configuration according to FIG. 1 but with the difference in that an insulation layer 12 is additionally provided as an innermost layer.

Figure 3:
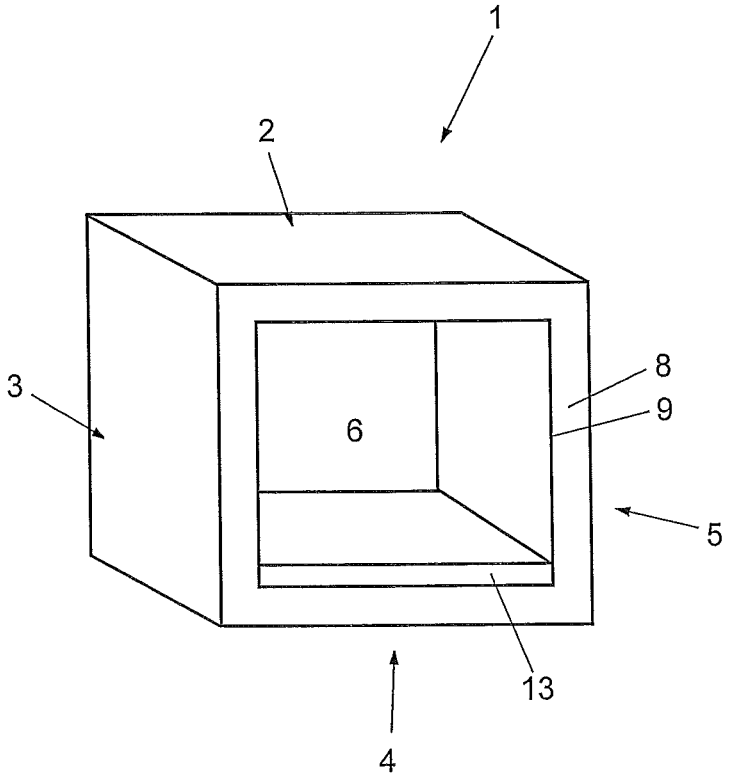
FIG. 3 illustrates a third configuration of the transport container according to the invention.

In the configuration according to FIG. 3, the latent heat accumulator is not designed as a latent heat accumulator layer surrounding the interior of the transport container on all sides, but is designed as a latent heat accumulator element 13 arranged only in the region of the wall 4. The layered structure of the walls merely comprises an insulation layer 8 and an energy distribution layer 9.

The invention claimed is:

1. A transport container for transporting temperature-sensitive transport goods, including an interior for receiving the transport goods, which is defined by an enclosure having walls defining sides of the transport container, the sides including a top side and a bottom side, the walls surrounding and enclosing the interior on all sides, said enclosure walls comprising several superimposed layers including a first layer being an energy distribution layer, a second layer being a flat chemical latent heat accumulator layer comprising phase change material or comprising a latent heat accumulator element, and a third layer being an energy distribution layer, wherein the first layer is disposed on a side of the second layer facing away from the interior of the transport container, wherein the second layer has a side facing towards the first layer and an opposite side facing towards the interior of the transport container, wherein the third layer is disposed on the opposite side of the second layer facing the interior of the transport container, wherein in the enclosure the first layer surrounds the interior of the transport container on all sides thereby causing thermal energy acting thereon to be distributed over the entire periphery of the enclosure, wherein in the enclosure the third layer surrounds the interior of the transport container on all sides thereby causing thermal energy acting thereon to be distributed over the entire periphery of the enclosure, wherein the first layer and third layer are not connected to each other, and wherein the first layer and the third layer in each wall are made of a highly heat-conductive material having a thermal conductivity $\lambda>200$ W/(m·K).

2. The transport container according to claim 1, wherein said several superimposed layers in each wall further comprise a fourth layer being an insulation layer, wherein the first layer in each wall is disposed between the second layer and the fourth layer.

3. The transport container according to claim 2, wherein said several superimposed layers in each wall further comprise a fifth layer being an energy distribution layer made of a highly heat-conductive material having a thermal conductivity $\lambda>200$ W/(m·K), wherein the fourth layer in each wall is disposed between the first layer and the fifth layer.

4. The transport container according to claim 2, wherein the fourth layer exhibits a conductivity $\lambda<0.05$ W/(m·K).

5. The transport container according to claim 4, characterized in that the fourth layer exhibits a conductivity $\lambda<0.03$ W/(m·K).

6. The transport container according to claim 2, wherein the fourth layer has a thickness of 10 to 200 mm.

7. The transport container according to claim 1, wherein the first layer and the third layer are made at least partially of aluminum, copper, or carbon nanotubes.

8. The transport container according to claim 1, wherein the first layer and/or the third layer is each comprised of at least two different materials having different thermal conductivities.

9. The transport container according to claim 1, wherein the first and/or the third layer comprises portions of smaller cross section and portions of larger cross section.

10. The transport container according to claim 1, wherein the first and/or the third layer comprises openings.

11. The transport container according to claim 1, wherein the enclosure further comprises an active temperature-control layer.

12. A transport container for transporting temperature-sensitive transport goods, having an interior for receiving the transport goods, the interior having sides including a bottom side and a top side; and an enclosure that surrounds and defines the interior, said enclosure comprising walls having several layers, wherein each wall comprises layers in the following order, an outer energy distribution layer having an outer face directed away from the interior and an inward face, an insulation layer having an outer face that is disposed over and contiguous with the inward face of the outer energy distribution layer, and the insulation layer having an inner face, an inner energy distribution layer having an outer face that is disposed over and contiguous with the inner face of the insulation layer, and the inner energy distribution layer having an inner face, a flat chemical latent heat accumulator layer having an outer face disposed over and contiguous with the inner face of the inner energy distribution layer, and the latent heat accumulator having an inner face, and an internal energy distribution layer having an outer face disposed over and contiguous with the inner face of the latent heat accumulator layer, wherein the internal energy distribution layer has an inner face that faces the interior of the transport container, wherein the internal energy distribution layer and the inner energy distribution layer are not connected to each other, and wherein each energy distribution layer comprises a highly-heat conductive material, has a thermal conductivity of $\lambda>200$ W/(m·K), and surrounds the interior on all sides.

13. The transport container according to claim 12, wherein at least one of the energy distribution layers is at least partially comprised of aluminum, copper, or carbon nanotubes.

14. The transport container according to claim 13, wherein at least one of the energy distribution layers is comprised of at least two different materials having different thermal conductivities.

15. The transport container according to claim 12, wherein at least one of the energy distribution layers comprises portions of smaller cross section and portions of larger cross section.

16. A transport container for transporting temperature-sensitive goods comprising an enclosure comprising walls with each wall having several layers, said walls surround and define an interior for receiving temperature-sensitive goods, said interior having sides including a bottom side and a top side, and said walls comprising layers in the following order, an outer energy distribution layer having an outer face directed away from the interior and an inward face, an insulation layer adjoining the outer energy distribution layer, the insulation layer having an outer face directed away from the interior, wherein the inward face of the outer energy distribution layer is superimposed on and contiguous with the outer face of the insulation layer, and the insulation layer having an inner face, an inner energy distribution adjoining the insulation layer, the inner energy distribution layer having an outer face directed away from the interior, wherein the inner face of the insulation layer is superimposed on and contiguous with the outer face of the inner energy distribution layer, and the inner energy distribution layer having an inner face, a flat chemical latent heat accumulator layer adjacent the inner energy distribution layer, the latent heat accumulator layer having an outer face directed away from the interior, wherein the inner face of the inner energy distribution layer is superimposed on and contiguous with the outer face of the latent heat accumulator layer, and the latent heat accumulator having an inner face, and an internal energy distribution layer adjoining the latent heat accumulator, the internal energy distribution layer having an outer face directed away from the interior, wherein the inner face of the latent heat accumulator layer is superimposed on and contiguous with the outer face of the internal energy distribution layer, wherein the internal energy distribution layer has an inner face that faces the interior of the transport container, wherein the internal energy distribution layer and the inner energy distribution layer are not connected to each other, and wherein the energy distribution layers comprise a highly-heat conductive material, have a thermal conductivity of $\lambda>200$ W/(m·K), and surround the interior on all sides.

* * * * *